United States Patent [19]

Raudsepp et al.

[11] Patent Number: 4,647,307

[45] Date of Patent: Mar. 3, 1987

[54] PROCESS FOR RECOVERING GOLD AND SILVER FROM REFRACTORY ORES

[76] Inventors: Rein Raudsepp, 3939 West 20th Avenue; Ernest Peters, 2708 W. 33rd Avenue; Morris J. V. Beattie, 2955 W. 38th Avenue, all of Vancouver, B. C., Canada

[21] Appl. No.: 797,838

[22] Filed: Nov. 14, 1985

Related U.S. Application Data

[63] Continuation-in-part of Ser. No. 640,503, Aug. 13, 1984, which is a continuation-in-part of Ser. No. 458,846, Jan. 18, 1983.

[51] Int. Cl.[4] ..... C01G 49/00; C22B 11/04

[52] U.S. Cl. ..... 75/118 R; 75/2; 75/97 A; 75/101 R; 75/103; 75/108; 75/109; 423/27; 423/34; 423/42; 423/87; 423/140; 423/143; 423/150; 423/594; 423/602; 204/109

[58] Field of Search ..... 75/97 A, 101 R, 108, 75/109, 118 R, 103, 2; 423/27, 602, 34, 594, 42, 87, 150, 143, 140, 32; 204/109

[56] References Cited

U.S. PATENT DOCUMENTS

| | | | |
|---|---|---|---|
| 2,477,469 | 6/1946 | Thompson | 75/118 R |
| 2,805,936 | 9/1957 | Schaufelberger | 423/41 |
| 2,835,569 | 5/1958 | Reynaud et al. | 423/87 |
| 2,959,467 | 11/1960 | Yusef | 423/144 |
| 3,793,429 | 2/1974 | Queneau | 75/118 R |
| 3,888,748 | 6/1975 | Brennecke | 423/145 |
| 3,965,239 | 6/1976 | Posel | 423/41 |
| 4,331,469 | 5/1982 | Kunda | 75/118 R |

OTHER PUBLICATIONS

Bailar, Jr.; J. C. et al. *Comprehensive Inorganic Chemistry,* vol. 3, 1970, pp. 96-97.

*Primary Examiner*—John Doll
*Assistant Examiner*—Robert L. Stoll
*Attorney, Agent, or Firm*—Fulwider, Patton, Rieber, Lee & Utecht

[57] ABSTRACT

A process for the hydrometallurgical recovery of precious metal from an ore or concentrate containing at least some arsenopyrite or pyrite. The process comprises forming in a common volume space a gas phase and a liquid slurry comprising the ore or concentrate as the solid phase and acid and water as the liquid phase of the slurry effecting in the slurry an oxidation-reduction reaction between the arsenopyrite or pyrite and an oxidized nitrogen species in which the nitrogen has a valence of at least plus 3 thereby solubilizing in the liquid phase the arsenic, iron and sulphur in the arsenopyrite, or the iron and sulphur in the pyrite, and producing in the liquid phase nitric oxide in which the nitrogen has a valence of plus 2; releasing at least part of the nitric oxide from the liquid phase into the gas phase oxidizing the nitric oxide in the gas phase, to form an oxidized nitrogen species in which the nitrogen has a valence of at least plus 3; and absorbing the oxidized nitrogen species into the slurry wherein the oxidized nitrogen species become available for the oxidation-reduction reaction. The resultant treated slurry is subjected to a solid-liquid separation to produce a solid residue and a liquid fraction. Precious metal is recovered from the solid residue. The liquid fraction is recycled in the process.

29 Claims, 3 Drawing Figures

PROCESS FOR RECOVERING GOLD AND SILVER FROM REFRACTORY ORES

FIELD OF THE INVENTION

This is a continuation-in-part of application Ser. No. 640,503, filed Aug. 13, 1984, which application was a continuation-in-part of application Ser. No. 458,846, filed Jan. 18, 1983.

The invention relates to a novel environmentally amicable hydrometallurgical process for the recovery of precious metals such as gold and silver from arsenopyrite and pyrite concentrates and ores.

BACKGROUND OF THE INVENTION

The mineral arsenopyrite, in some instances, is known to contain gold and silver which are in solution in the mineral matrix or are present as fine inclusions in the mineral. The gold and silver are not available for extraction by conventional hydrometallurgical processes such as cyanidation which treat only the mineral surfaces. The mineral pyrite is often associated with arsenopyrite and these minerals may contain in their matrices finely dispersed gold which is difficult to extract.

The conventional means of liberating gold from pyrite and arsenopyrite concentrates is to roast the material and then treat the calcine by cyanidation. This process generates environmental pollution problems due to the airborne emission of sulphur and arsenic oxides. The tailings from the calcine cyanidation contain arsenic which is also a potential environmental contaminant.

Arsenopyrite and pyrite concentrates may also be treated for gold recovery through conventional pyrometallurgical processes which include copper smelting, lead smelting and zinc roasting. These processes also produce potentially harmful airborne arsenic emissions from the treatment of these concentrates. Problems associated with the added arsenic burden in the process flows also arise.

Two hydrometallurgical processes exist which could potentially be used to decompose arsenopyrite and pyrite concentrates though they are not specifically used for this purpose. These are the Sill and the Calera processes which are both used for the treatment of cobalt and arsenic-bearing materials. In the Sill process, the concentrate is solubilized by the action of a caustic substance and oxygen under elevated temperatures and pressures. In the Calera process, sulphuric acid and oxygen at high temperature and pressure are the active agents. Neither process, as far as is known, is commercially operated at the present time.

U.S. Pat. No. 3,793,429, Queneau, February, 1974, discloses a process for treating chalcopyrite and pyrite concentrates in an aqueous slurry for copper recovery while at the same time rejecting iron (column 1, lines 71–72, column 2, lines 1–5). Technology relating to the production of a copper-enriched solution from such chalcopyrite concentrates for the purpose of recovery of copper from the solution, while at the same time rejecting iron and sulphur to the leach residue, is not of much assistance in dealing with the objective of producing a pyrite or arsenopyrite leach residue suitable for gold recovery, while maintaining silver in the liquid fraction.

Queneau conducts his decomposition leach by continuously adding nitric acid to the aqueous slurry in quantities sufficient to completely decompose the chalcopyrite and pyrite concentrates. Queneau continuously removes the nitric oxide resulting from the decomposition reaction and externally generates nitrogen dioxide by the addition of oxygen. The nitrogen dioxide is then absorbed in water to form nitric acid which is recycled to the process. Queneau's process is very slow, particularly in decomposing pyrite, because the nitric acid regeneration step is extremely slow. Also, the nitric acid leaching is very slow.

The Queneau process purports to achieve 98 percent recovery of copper from the solution and gold recovery of 80 percent and silver of 10 percent from the residue (column 4, lines 53–57). Such a low gold recovery from the residue may be acceptable where the gold represents only a by-product from a copper solution recovery process, but it is not acceptable when the principal objective is to treat gold-bearing arsenopyrite and pyrite concentrates. Gold recovery by traditional roasting and cyanidation of such concentrates is generally from 90 percent to 95 percent.

One of the objectives of the Queneau process is to precipitate iron from the solution to produce a purified copper solution. This precipitation is done by removing the nitric oxide and thereby reducing the acidity of the solution. Lowering the acidity of the solution promotes basic iron sulphate precipitation.

It is well known in the art that when iron is precipitated as basic iron sulphate, any silver present in the solution is chemically bonded to and precipitates with the basic iron sulphate. It is then not economically feasible to recover the silver from the basic iron sulphate precipitate. Since the Queneau process does not achieve gold recovery levels of at least 90 percent, and silver is lost with the basic iron sulphate precipitate, Queneau's process is not suitable for the recovery of gold and silver from arsenopyrite and pyrite concentrates and ores.

The Queneau process also has a number of other serious shortcomings. In order to achieve the extraction level indicated in the Queneau patent, several steps must be followed. The concentrate must be ground very fine, for example, minus 270 mesh (53 microns) to minimize retention times. The leaching time is lengthy and multistaged: one hour for acid addition and two hours for nitrate reduction. The nitric oxide gas that is produced is oxidized separate from the leach vessel with the attendant need for gas-handling facilities. Unleached concentrate must be recovered by flotation of the leach residue and then recycled to the leach. Prior to the flotation of unreacted sulphides, the sulphur must be removed from the residue.

U.S. Pat. No. 4,331,469, W. Kunda, May 25, 1982, discloses a process for recovering silver from silver bearing concentrates which in some cases also contain iron and arsenic. Kunda teaches the use of a nitric acid system together with the use of a chloride salt for silver precipitation and pH increase to between 0.8 to 1.8 for iron precipitation. The use of a chloride salt makes it impossible to recycle the process solution in a gold recovery process as it would solubilize gold in the leach stage. The pH increase process for iron rejection yields a precipitate which is chemically unstable with respect to arsenic redissolution and has poor handling characteristics.

SUMMARY OF THE INVENTION

The subject invention is directed to an environmentally amicable hydrometallurgical process for the recovery of precious metal from an ore or concentrate containing arsenopyrite or pyrite by decomposing the arsenopyrite or pyrite concentrates and ores in acidic solution in a common volume space which contains a gas phase and a liquid slurry (which comprises a liquid phase and a solid phase) through the action of higher valence oxidized nitrogen species in which the nitrogen has a valence of at least plus 3. The active oxidized nitrogen species are regenerated in the same common volume space by an oxygen containing gas. The decomposed product in the liquid slurry can be subjected to a solid-liquid separation to produce a solid residue and a liquid fraction. The solid residue produced can be readily treated for the recovery of precious metal including gold and silver. Silver can be recovered from the liquid fraction. Any arsenic, iron and sulphur can be precipitated from the liquid fraction after it is separated from gold-bearing residues thereby making the liquid fraction suitable for reuse in the decomposition step.

The hydrometallurgical process for the recovery of precious metal from an ore or concentrate containing arsenopyrite or pyrite wherein at least some of the precious metal is occluded in the arsenopyrite or pyrite comprises:

(a) forming in a common volume space a gas phase and a liquid slurry comprising the ore or concentrate as the solid phase and acid and water as the liquid phase of the slurry;

(b) effecting in the slurry between the arsenopyrite or pyrite and a higher valence oxidized nitrogen species in which the nitrogen has a valence of at least plus 3 an oxidation-reduction reaction having a standard potential between about 0.90 and about 1.20 volts on the hydrogen scale, thereby solubilizing in the liquid phase the arsenic, iron and sulphur in the arsenopyrite or the iron and sulphur in the pyrite, all as the oxidation products, and producing in the liquid phase nitric oxide (NO) in which the nitrogen has a valence of plus 2, as the reduction product;

(c) releasing at least part of the nitric oxide from the liquid phase into the gas phase;

(d) oxidizing the nitric oxide in the gas phase, in which a significant oxygen partial pressure is maintained by continuous addition of an oxygen containing gas, to form a higher valence oxidized nitrogen species in which the nitrogen has a valence of at least plus 3, the total amount of oxygen added being at least in an amount stoichiometrically required for solubilization in the liquid phase of the arsenic, iron and sulphur in the arsenopyrite or the iron and sulphur in the pyrite;

(e) absorbing the higher valence oxidized nitrogen species into the slurry wherein the oxidized nitrogen species become available for the oxidation-reduction reaction of step (b) whereby the nitrogen, in its oxide forms, functions as a catalyst for the transport of oxygen from the gas phase to the oxidation-reduction reactions in the slurry, thereby permitting the total of the oxidized nitrogen species and nitric oxide in the system to be substantially less than a stoichiometric balance required for the oxidation of the arsenic, iron and sulphur;

(f) subjecting the slurry to a solid-liquid separation to produce a solid residue and a liquid fraction; and (g) recovering precious metal from the solid residue.

In the process, the oxidation-reduction reaction can have a standard potential of at least 0.94 and less than about 1.0 volts on the hydrogen scale. The nitrogen in the oxidized nitrogen species can have a valence of plus 3 or 4. In the process, the arsenic and iron in the arsenopyrite and the iron in the pyrite can be completely solubilized while the sulphur in the arsenopyrite and the pyrite can be substantially solubilized.

The process can be initiated by the addition to the common volume space of an oxidized nitrogen species of a valence of at least +2. In the process, the oxidized nitrogen species can be added to the gas phase as nitric oxide NO, nitrogen dioxide $NO_2$ or nitrogen tetroxide $N_2O_4$. The oxidized nitrogen species can be added to the liquid phase as $HNO_3$, $NaNO_3$, $KNO_3$, $NaNO_2$, $Fe(NO_3)_3$, $NH_4NO_3$, $Ca(NO_3)_2$ or $Mg(NO_3)_2$.

Solubilized iron, arsenic and sulphur can be precipitated from at least a portion of the liquid fraction and the precipitated iron, arsenic and sulphur can be removed from the process. The liquid fraction can be recycled to become part of the liquid phase in the process. The liquid fraction can contain the oxidized nitrogen species required to initiate and maintain the process. The reactions of steps (b), (c), (d) and (e) can be conducted within a residence time of about 2 minutes to about 60 minutes. The oxidation-reduction reaction can be conducted at a temperature in the range of about 60° C. to about 180° C. The oxidation-reduction reaction can be conducted at a pH of less than about 3, preferably at a pH of less than about 1 to about 1.

In the process, the oxidized nitrogen species concentration can be between about 0.25 Molar (M) to about 4.0 Molar (M), preferably between about 0.5 Molar (M) to about 3.0 Molar (M).

Any solubilized iron, arsenic or sulfur can be precipitated as jarosite and ferric arsenate from the liquid fraction by raising the temperature of the liquid fraction to a temperature of at least 100° C. and removing precipitated solids from the liquid fraction before recycling the liquid fraction to become part of the liquid phase of the process. Alternatively, any solubilized iron, arsenic or sulfur can be precipitated as jarosite, ferric arsenate, and anhydrite from the liquid fraction by neutralization of any surplus acid generated in the process, and removing precipitated solids from the liquid fraction before recycling the liquid fraction to become part of the liquid phase.

In the process, a calcium or barium bearing substance can be used to remove solubilized sulphur from the liquid fraction, ferric arsenate can be added as a nucleating agent, and the liquid fraction can be heated, preferably to about 100° C., to precipitate solubilized iron and arsenic as ferric arsenate.

In the process, the precious metal can be gold, silver or one of the platinum group of metals. Where the ore or concentrate contains silver, at least some of the silver can be recovered from the separated liquid fraction by using at least a stoichiometric quantity of a thiocyanate substance to precipitate the silver. The thiocyanate can be sodium thiocyanate, potassium thiocyanate or ammonium thiocyanate.

Utilizing the process, any carbonaceous matter in the ore or concentrate which is in the activated form and will therefore interfere with later cyanidation of gold can be deactivated.

When the arsenic concentration is sufficient in the liquid fraction, arsenic trioxide can be recovered from the liquid fraction by cooling the liquid fraction.

The invention is also directed to a process for the recovery of silver from a nitrate solution containing silver which comprises precipitating the silver by adding at least a stoichiometric quantity of a thiocyanate substance to the solution, separating the silver thiocyanate precipitate by subjecting the solution to a solid-liquid separation, and recovering the silver. The silver can be recovered by smelting the silver thiocyanate precipitate.

The invention is also directed to a process for removing arsenic and iron from an acidic aqueous acid solution containing nitric acid, solubilized arsenic, iron and sulphur which comprises adding a calcium or barium bearing substance to remove solubilized sulphur from the solution, adding a nucleating substance to the solution, and heating the solution to precipitate ferric arsenate.

DRAWINGS

DETAILED DESCRIPTION OF THE INVENTION

Figure 1:
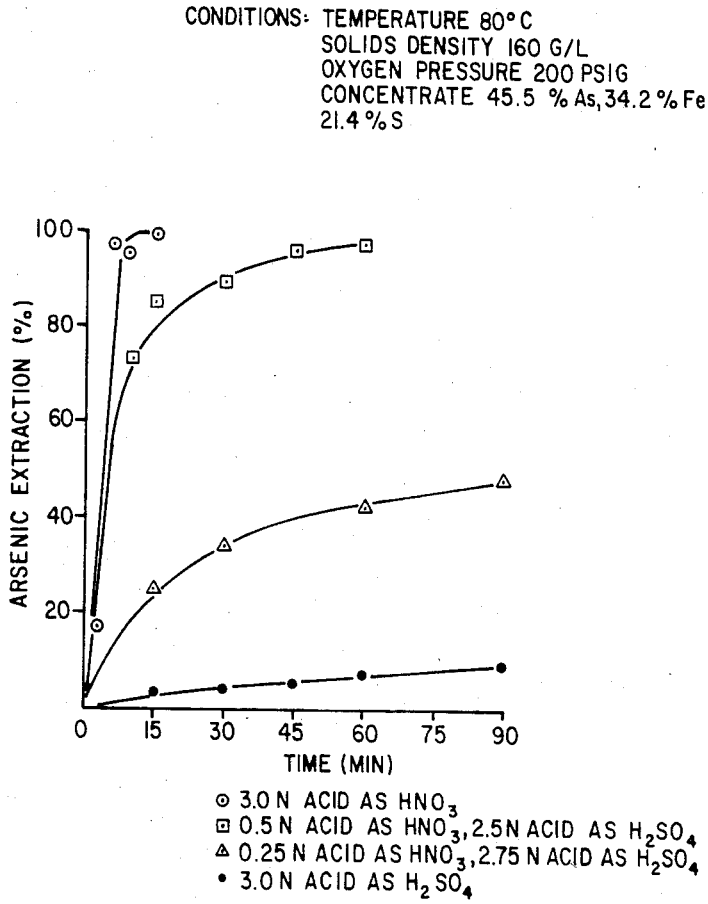
FIG. 1 illustrates the effect of oxidized nitrogen species concentration on the rate of arsenopyrite decomposition.

This hydrometallurgical process is intended for the recovery of precious metal from an ore or concentrate containing arsenopyrite or pyrite wherein at least some of the precious metal is occluded in the arsenopyrite or pyrite. A gas phase and a liquid slurry are formed in a common volume space. The slurry is comprised of the ore or concentrate as a solid phase and acid and water as a liquid phase. An oxidation-reduction reaction having a standard potential between about 0.90 and about 1.20 volts on the hydrogen scale is effected in the slurry between the arsenopyrite or pyrite and an oxidized nitrogen species in which the nitrogen has a valence of at least plus 3. Arsenic, iron and sulphur in the arsenopyrite, or iron and sulphur in the pyrite, are solubilized in the liquid phase as oxidation products. Nitric oxide in which the nitrogen has a valence of plus 2 is produced as a reduction product in the liquid phase. At least part of the nitric oxide is released from the liquid phase into the gas phase. The nitric oxide in the gas phase, in which a significant oxygen partial pressure is maintained by the continuous addition of an oxygen containing gas, is oxidized to form an oxidized nitrogen species in which the nitrogen has a valence of at least plus 3. The total amount of oxygen added is at least in an amount stoichiometrically required for solubilization in the liquid phase of the arsenic, iron and sulphur in the arsenopyrite, or the iron and sulphur in the pyrite. The oxidized nitrogen species are absorbed into the slurry wherein the oxidized nitrogen species become available for the oxidation-reduction reaction. The nitrogen, in its oxide forms, functions as a catalyst for the transport of oxygen from the gas phase to the oxidation-reduction reactions in the slurry. This permits the total of the oxidized nitrogen species and nitric oxide in the system to be substantially less than a stoichiometric balance required for the oxidation of the arsenic, iron and sulphur. The slurry is removed from the common volume space and is subjected to a solid-liquid separation to produce a solid residue and a liquid fraction. Precious metal is recovered from the solid residue.

The arsenopyrite and pyrite are decomposed by the oxidation-reduction reaction in acid solutions in the slurry where the pH is less than about 1.0 to about 3 by the action of oxidized nitrogen species where the nitrogen has a valence of plus 3 or greater. These oxidized nitrogen species include nitrous acid and nitrogen dioxide. The oxidized nitrogen species are present in sufficient concentration in the liquid fraction (typically about 0.25 Molar (M) to about 4.0 Molar (M), calculated on a nitric acid basis) to provide an adequate rate of dissolution (typically within a residence time of about 2 minutes to about 60 minutes) at the reaction temperature used (typically about 60° C. to about 119° C. for arsenopyrite concentrate and about 60° C. to about 180° C. for pyrite concentrate or ore). Normally, the lower oxidized nitrogen species concentrations and longer residence times are used when treating ore while the higher oxidized nitrogen species concentrations and shorter residence times are used when treating concentrates.

The main products from the oxidation-reduction reaction are soluble ferric iron species, soluble arsenate species, soluble sulphate species, minor amounts of elemental sulphur and nitric oxide.

Insoluble gangue minerals and elemental sulfur remain as solids in the slurry. The slurry is subjected to a solid-liquid separation to yield a solid residue and a liquid fraction. The gold or other precious metal contained in the concentrate or ore remains in the solid residue. Almost all of the silver present in the concentrate will usually remain in the liquid fraction. The silver can be recovered from the liquid fraction by using a thiocyanate compound such as sodium thiocyanate, potassium thiocyanate, or ammonium thiocyanate. Sulphate is removed from the liquid fraction by the addition of calcium bearing materials to form calcium sulphate. Arsenic and iron are removed from the silver-free separated liquid fraction by elevating the temperature to precipitate ferric arsenate. In the case of pyrite, iron is removed from the liquid fraction.

In this specification and the following claims:

"Common volume space" means a closed reaction vessel which contains a gas phase and a liquid slurry in which the oxidation-reduction reaction, nitric oxide release, nitric oxide oxidation and nitrogen oxides absorption steps of the process are conducted.

"Liquid slurry" means a suspension of particulate solids (solid phase) in a liquid phase.

"Liquid fraction" means the component which is separated by a solid-liquid separation process conducted on the liquid slurry after it is removed from the common volume space.

"Solid residue" means the solid fraction which remains after the liquid fraction is separated from the liquid slurry.

"Precious metals" means gold, silver or one of the platinum group of metals.

"Platinum group of metals" means platinum, iridium, osmium, palladium, rhodium and ruthenium.

"Occluded" means a particle of precious metal substantially smaller than an arsenopyrite or pyrite grain and completely surrounded by the arsenopyrite or pyrite grain.

"M" means an abbreviation for "Molar".

In general terms, the process of the invention can be operated at a standard potential between the arsenopyrite or pyrite and the oxidized nitrogen species of about 0.90 volts and about 1.20 volts on the hydrogen scale. At potentials below about 0.9 volts, arsenopyrite or pyrite will not decompose efficiently. At potentials above about 1.2 volts, no significant oxidation of the nitrogen species will take place because oxygen per se has a potential of about 1.23 volts on the hydrogen scale.

On the standard oxidation-reduction potential scale, the reduction of nitrous acid to nitric oxide has a standard potential of about 0.996 volts. The reduction of nitrate to nitrous acid has a standard potential of about 0.94 volts. Thus the former couple has a higher driving force than the latter in decomposing sulphide minerals such as arsenopyrite and pyrite.

Preferably, the process of the invention is operated at a potential greater than about 0.94 volts up to about 1.0 volts on the hydrogen scale.

The process can typically be conducted within a residence time range of about 2 minutes to about 60 minutes calculated on a plug flow basis. A process which is completed in a time less than about 2 minutes is difficult to control and basically impractical. On the other hand, a process which takes more than about 60 minutes to complete is too slow and thus uneconomical.

The process has been conducted experimentally at initial temperatures from above the freezing point of the slurry to temperatures of several hundred degrees Celsius. However, temperatures falling in the range of about 60° C. to about 180° C. are preferred for economical reasons. Similarly, the process has been conducted at pH ranges of less than about 1.0 to as high as about 3.0. In situations where silver is not present, and the formation of basic iron sulphate or jarosite can be tolerated in the process, the process can be conducted at a pH of about 3.0. However, silver is usually present and therefore it is preferable to operate the process at lower pH ranges. Typically, a pH of about 1.0 or below is preferred because it is desirable to keep the iron and arsenic in solution. Also, the process is more rapid and economical at a pH range of less than about 1.0.

In the process, the oxidized nitrogen species in a sense act as a transporter of oxygen. The process may be regarded as an oxygen leach rather than an oxidized nitrogen species or nitric acid leach. The oxidized nitrogen species serves as a carrier for the oxygen as the oxidized nitrogen species is cycled between the gas phase and the liquid phase of the slurry of the common volume space. It follows that the rate at which the reaction proceeds is proportional to the number of oxidized nitrogen species carriers that are in the process.

Sufficient oxygen must be supplied to the common volume space in order to completely decompose the arsenopyrite and pyrite in the slurry. If insufficient oxygen is supplied, then the pressure of the nitric oxide generated increases and ultimately the reaction stops because there are no oxidized nitrogen species left in the liquid phase of the slurry.

The decomposition of arsenopyrite and pyrite by oxidation occurs according to the following reactions.

A. Mineral Oxidations $$\text{Fe AsS} — Fe^{+3}(aq) + \tfrac{1}{2}As_2S_2 + 3e \quad (1)$$

$$FeAsS + 3H_2O — Fe^{+3} + H_3AsO_3 + S^0 + 3H^+ + 6e \quad (2)$$

$$FeAsS + 4H_2O — Fe^{+3} + H_3AsO_4 + S^0 + 5H^+ + 8e \quad (3)$$

$$FeAsS + 8H_2O — Fe^{+3} + H_3AsO_4 + SO_4^{=} + 13H^+ + 14e \quad (4)$$

$$FeS_2 — Fe^{+3}(aq) + 2S^0 + 3e \quad (5)$$

$$FeS_2 + 8H_2O — Fe^{+3} + 2SO_4^{=} + 16H^+ + 15e \quad (6)$$

B. Oxidized Nitrogen Species Reduction $$HNO_3 + 3H^+ + 3e — NO(g) + 2H_2O \quad (7)$$

$$HNO_2 + H^+ + e — NO(g) + H_2O \quad (8)$$

In the oxidation of arsenopyrite, it has been found that 60–90% of the mineral's sulphur is converted to soluble sulphate species. In the oxidation of pyrite, the degree of conversion is 80–100%.

While the inventors do not wish to be bound by any theories, the following comments are made in an effort to facilitate an understanding of the invention. It is well known that chalcopyrite will decompose at an oxidation potential of 0.75 volts on the hydrogen scale (e.g. as in a ferric chloride leach) while pyrite and arsenopyrite are unaffected. Potentials of about 0.75 to 0.90 volts on the hydrogen scale do not decompose arsenopyrite and pyrite at a useful rate because it is believed these two minerals are protected by a coherent coating of $As_2S_2$ or elemental sulphur which is formed as a result of any iron extraction from the mineral. Most other sulphide minerals also form a sulphur or $As_2S_2$ coating but this leaching residual does not seriously protect the underlying unreacted mineral because the residual coating is cracked and fissured as a result of volume decreases when the iron or other base metal is leached out. Only pyrite (coated by elemental sulphur) and arsenopyrite (coated by $As_2S_2$) would be protected by such leach products because, in these cases, the coating is formed with an accompanying volume increase. Thus the coating does not form cracks that permit further access to the underlying unreacted mineral by the acidic liquid phase.

At a potential of above 0.90 volts on the hydrogen scale, the oxidation of sulphur begins to become significant, and is sufficiently rapid above 0.94 volts to expose unreacted mineral continuously. In the absence of a protective sulphur or $AsS_2$ coating, both pyrite and arsenopyrite react very rapidly.

Equations A(1) and A(5) will, in principle, take place at potentials above about 0.6 volts on the hydrogen scale; however, since $\frac{1}{2}$ ($As_2S_2$) on arsenopyrite and $2S^0$ on pyrite have molar volumes larger than FeAsS and $FeS_2$ respectively, the first submicroscopic layers of these leach products protect the mineral from further oxidation, and no substantial reaction is observed. At potentials above about 0.94 volts on the hydrogen scale, reactions A(4) and A(6) take place, and the protective layers of $As_2S_2$ and $S^0$ are eliminated by oxidation. Reaction B(7) absorbs electrons at a standard potential of 0.94 volts on the hydrogen scale, just barely adequate to remove electrons from arsenopyrite and pyrite to drive reactions A(4) and A(6) at a feasible rate (as in Queneau). Reaction B(8) absorbs electrons at a standard potential of 0.996 volts on the hydrogen scale, which is high enough to drive reactions A(4) and A(6) rapidly at temperatures as low as 60° C.

The active nitrogen oxides are required only to act as a sink for electrons which are released by decomposition of the minerals in the concentrate or ore. The oxidized nitrogen species should be present in sufficient concentration in the solution (typically about 0.25M to about 3.0M or 4.0M) to provide an adequate rate of dissolution (typically within a residence time of about 2 minutes to about 60 minutes) at the reaction temperature used (typically about 60° C. to about 119° C. for arsenopyrite concentrate, and about 60° C. to about 180° C. for pyrite concentrate or ore). Sulphuric acid may be used to form the soluble ferric iron species and under certain circumstances is produced in situ.

In the following reaction, nitrous acid is the decomposition agent for arsenopyrite with sulphuric acid present.

$$FeAsS+\tfrac{1}{2}H_2SO_4+14HNO_2 \rightarrow \tfrac{1}{2}Fe_2(SO_4)_3+H_3AsO_4+14NO(g)+6H_2O \quad (9)$$

Sufficient sulphuric acid was supplied with arsenopyrite and was consumed to form soluble ferric iron species. Without such acid, compounds will precipitate from solution.

In the reaction detailed below, the sulphuric acid is generated from the decomposition of pyrite.

$$FeS_2+15HNO_2 \rightarrow \tfrac{1}{2}Fe_2(SO_4)_3+\tfrac{1}{2}H_2SO_4+15NO(g)+7H_2O \quad (10)$$

In the preceding reactions, the active nitrogen oxides are reduced to nitric oxide which may then be regenerated by an oxidant. A useful oxidant is oxygen which reacts with nitric oxide in the presence of water to form nitrogen dioxide, nitrous acid and nitric acid as shown in the reactions set forth below.

$$NO+\tfrac{1}{2}O_2=NO_2 \quad (11)$$

$$NO+NO_2+H_2O=2HNO_2 \quad (12)$$

$$3HNO_2=HNO_3+H_2O+2NO \quad (13)$$

The generation of nitric acid (reaction (13)) is not desirable and is to be avoided. This is accomplished by conducting reactions A(4) and A(6), B(8) and reactions (11) and (12) in a common volume space where the nitrous acid can be readily consumed by reactions (9) and (10) so as not to form nitric acid according to reaction (13). The regeneration of nitric oxide to the higher valence states is done concurrently with the decomposition of pyrite in the common volume space.

It is clear from equations (11) to (13) that $HNO_2$ is the principal dissolved oxidized nitrogen species arising from the gas phase oxidation of NO and dissolution of the resulting $NO_2$. Reaction (13) is rather slow, and $HNO_2$ is therefore the principal dissolved oxidized nitrogen species that is able to react with the oxidizable minerals (reactions (9) and (10)). Oxygen is used for nitrogen oxide regeneration. The rate of regeneration varies directly with oxygen partial pressure. Any oxygen partial pressure above ambient is adequate, but oxygen partial pressures of about 50 p.s.i.g. to about 100 p.s.i.g. are preferred. The regeneration step is carried out with an oxygen containing gas concurrently with the decomposition reaction(s) (reactions A(4) and A(6)). The overall stoichiometry of arsenopyrite reacting with sulphuric acid and oxygen utilizing the oxidized nitrogen species as a catalyst (transporter) is illustrated by the reaction below.

$$FeAsS + \tfrac{1}{2}H_2SO_4 + 7/2\,O_2 + H_2O + 14\,HNO_2 = \tfrac{1}{2}\,Fe_2(SO_4)_3 + H_3AsO_4 + 14\,HNO_2 \quad (14)$$

Since the active oxidized nitrogen species are regenerated during the decomposition step in the common volume space, the quantity of these species present at any time may be quite small.

FIG. 1 shows the effect of oxidized nitrogen species concentration on the rate of arsenopyrite decomposition. Sufficient oxygen was supplied in each case to continuously regenerate the oxidized nitrogen species and thereby satisfy the requirements of the mineral oxidation as it progressed.

The variation in solution composition was an increase of the molar ratio of oxidized nitrogen species to arsenopyrite. Nitric acid was used as a convenient source of the oxidized nitrogen species. The other experimental conditions are given on FIG. 1. It is apparent from the data that the presence of the increased oxidized nitrogen species, (i.e. increasing concentrations) increases the rate of reaction. The results are shown for a period of 90 minutes. If given sufficient time, ie., several hours, all tests would have shown that the reactions have progressed to completion.

The data in FIG. 1 were obtained with approximately 1 Molar FeAsS ground to 60 percent minus 200 mesh. It is apparent from equation calculations that the $HNO_3$ concentrations initially added are far too low to completely decompose so much arsenopyrite. If the initially present $HNO_3$ were the only oxidant, and remained the only oxidant, stoichiometric calculations would show that a minimum of 5 moles of $HNO_3$ would have been required to completely decompose the 1 mole of arsenopyrite. This is evidenced by the following equation:

$$FeAsS+5HNO_3 \rightarrow \tfrac{1}{3}FE_2(SO_4)_3+\tfrac{1}{3}FE(NO_3)_2+H_3AsO_4+H_2O+5NO(g) \quad (15)$$

Yet, the mineral was completely decomposed by as little as 0.5M $HNO_3$, or 1/10 of the stoichiometric requirement, for example, oxidized nitrogen species cycled ten times. This illustrates the highly catalytic property of the oxidized nitrogen species.

At oxidized nitrogen species concentrations of 0.25M or less, the decomposition rate is too slow to be a practical consideration. At oxidized nitrogen species concentrations of about 3.0M, the reaction rate is very rapid and hence sufficient for most purposes. Greater concentrations than about 3.0M do not provide greatly improved reaction rates.

Figure 2:
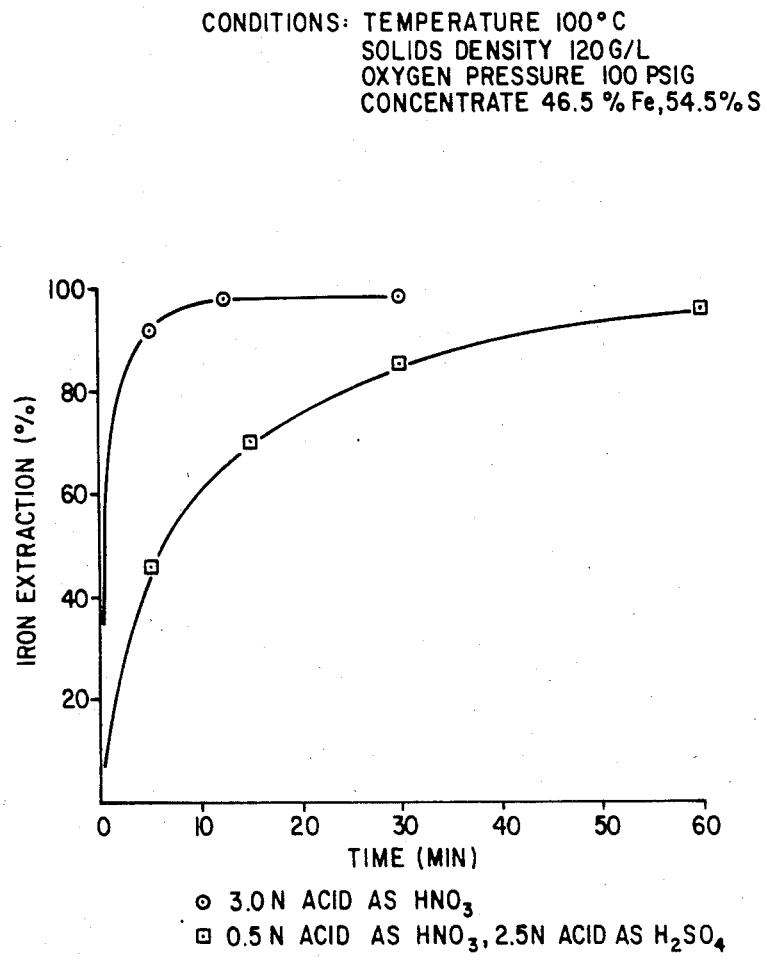
FIG. 2 illustrates the effect of oxidized nitrogen species concentration on the rate of pyrite decomposition.

FIG. 2 shows the effect of oxidized nitrogen species concentration on the rate of pyrite decomposition. The quantity of oxidized nitrogen species was sub-stochiometric for complete pyrite oxidation. Sufficient oxygen was supplied in each case to continuously regenerate the oxidized nitrogen species and thereby satisfy the requirements of the mineral oxidation as it progressed. Again, for the reasons explained in association with FIG. 1, the data of FIG. 2 clearly demonstrate the highly catalytic property of the oxidized nitrogen species on pyrite decomposition.

The mineral decomposition and oxidized nitrogen species regeneration steps are both exothermic. Thus, in conducting the reactions, the slurry in the common volume space must be cooled in order to maintain a constant operating temperature.

The decomposition leach can be carried out over a wide range of solid-liquid ratios. Increasing the ratio of solids to liquids provides economic benefits, but the upper limit of this ratio is reached when the solubility limit of dissolved species is reached.

The choice of oxidized nitrogen species concentration, decomposition temperature and time for leaching is governed by the nature of the material to be leached and by the process steps required to produce the recycled solution used for decomposition. Convenient initial sources of the oxidized nitrogen species are nitric oxide gas or nitric acid. The solids are decomposed in a single pass and no recycle of solids is required. When the decomposition reactions are complete, a solid-liquid separation is carried out to produce a solid residue containing all of the gold and a clarified liquid fraction which may contain silver.

The applicant's process as one inventive variation offers the option of producing high purity arsenic trioxide. The conditions of the leach can be varied to maximize the presence of the extracted arsenic as soluble arsenite. Arsenic trioxide can then be precipitated by cooling the filtered decomposition solution. By using a low decomposition temperature (70° C.) and a low concentration of oxidized nitrogen species (0.5M $HNO_3$ for 1.25M FeAsS) and then cooling the filtered decomposition solution to 10° C., it was found that 35 percent of the extracted arsenic was recovered as $As_2O_3$. Normally, however, when arsenic trioxide production is not required, process conditions are chosen so as to maximize to oxidiation of arsenic to the arsenate state.

The separation of silver from the acidic liquid fraction which contains iron, arsenic, sulphate and oxidized nitrogen species represents another inventive aspect of the process.

A portion of the silver present in the concentrate or ore reports to the liquid fraction. The silver may be recovered as a thiocyanate compound with the addition of one mole of thiocyanate per mole of silver. The reaction time involved is very short, typically about one minute. Thiocyanate compounds which can be used are sodium thiocyanate, potassium thiocyanate or ammonium thiocyanate.

At high solution temperatures, thiocyanate is oxidized by the oxidized nitrogen species present in the solution. In a solution which is three molar in nitrate ions, oxidation of the thiocyanate occurs at an increased rate at temperatures in excess of about 80° C. Therefore, if the leach is conducted at a temperature of 100° C., for example, the liquid fraction should be cooled to about 80° C. or lower, eg., down to 60° C., in order to avoid decomposing the thiocyanate. An important and unique feature of the silver removal process is that the thiocyanate added in excess of that required for silver removal reacts with the ferric iron present to form soluble ferric thiocyanate complexes which have an intense red colour. The presence of this red colour acts as an indicator to show that sufficient thiocyanate has been added. A solid and liquid separation is carried out to recover the silver thiocyanate precipitate. The silver can be recovered from the precipitate by smelting or by conventional hydrometallurgical treatment. The liquid separated is suitable for recycle to the liquid slurry.

It is important for operative reasons that dissolved arsenic, iron and sulphur be removed from the silver-free solution. Following removal of these compounds, the solution can be recycled to the decomposition process, if desired. Dissolved arsenic is removed from solution with dissolved iron in the form of ferric arsenate. The fact that ferric arsenate can be formed under such strong acidic conditions, even in the presence of sulphate, is an important discovery and represents another inventive aspect of the process.

The following reaction shows the formation of ferric arsenate from ferric nitrate and arsenic acid (arsenate).

$$Fe(NO_3)_3 + H_3AsO_4 = 3\ HNO_3 + FeAsO_4.2H_2O + 2\ H_2O \quad (13)$$

Ferric arsenate is produced, virtually quantitatively from an equimolar solution of ferric nitrate and arsenate at all temperatures above ambient. However, the rate can be controlled by temperature regulation and by the addition of nucleating agents. With an unnucleated solution at room temperature, complete precipitation (>95 percent removal of iron and arsenate) requires several months; at 100° C., precipitation requires several hours; and at 200° C., precipitation occurs in less than one hour. When nucleated by fine ferric arsenate, the rates become more rapid.

The ferric arsenate produced is a crystalline solid which shows the X-ray diffraction pattern of $FeAsO_4.2H_2O$. The solubility of this material, when mixed with water, is very low (less than 1 ppm arsenic). The crystalline ferric arsenate is unique in that it precipitates from a strong nitric acid solution. For example, a ferric arsenate precipitate has been produced in 5 N $HNO_3$.

The crystalline ferric arsenate obtained from this process is distinctly different from the ferric arsenate that is produced from the neutralization of acidic ferric nitrate and arsenate solutions. The latter material is colloidal and shows no X-ray diffraction pattern. When mixed with water, the solubility of the amorphous ferric arsenate is in excess of 20 ppm arsenic. The amorphous ferric arsenate is difficult to filter and can contain ferric hydroxide which also tends to be colloidal and hence difficult to filter.

It has been discovered that the presence of sulphate in solution hampers the formation of crystalline ferric arsenate. This discovery represents another inventive aspect of the process. Sulphate must be removed from solution prior to ferric arsenate precipitation. A solution which is 1M in ferric nitrate and arsenate is stable at 100° C. in the presence of 0.8M sulphate as $H_2SO_4$.

A calcium-bearing substance such as calcium oxide, calcium hydroxide or calcium carbonate, or a barium-bearing substance such as barium carbonate, can be used to remove sulphate in order to facilitate crystalline ferric arsenate precipitation. The calcium and barium bearing substances also partially neutralize the solutions, however amorphous ferric arsenate is not produced if the rate of addition of the neutralizing agent is slow. The mixture of crystalline ferric arsenate and calcium or barium sulphate filters very well.

Because of the inhibiting effect of sulphate on the formation of ferric arsenate, the rate of ferric arsenate precipitation is dependent on the rate of calcium sulphate precipitation. At high temperature, e.g. over 150° C., 95 percent of the iron and arsenic is removed in less than one hour. At 100° C., while some sulphate is present, in the absence of a nucleation agent, the rate of iron and arsenic removal is slower, i.e. 95 percent removal requires in excess of 12 hours. At 100° C., when sulphate removal is complete, and nucleation is provided by recycling previously formed ferric arsenate, 95 percent removal can be achieved in one hour. Arsenic removal proceeds at a satisfactory rate at temperatures below 100° C. when sulphate removal is complete and a nucleation agent is provided.

When treating pyritic concentrates, ferric iron is removed from solution by the formation of insoluble iron compounds e.g. ferric hydroxide or basic iron sulfate through the neutralization of the solution.

The tendency for silver to be bound up with jarosite results in silver losses if jarosite precipitates are formed during the decomposition step of the process. However, jarosites do not form promptly from supersaturated solutions since they are a crystalline, filterable solid that nucleates very slowly. A high acid level suppresses the formation of jarosite. The applicants have found that it is possible with the process to conduct the decomposition step in such a way that all the iron, and arsenic, and most of the sulphur, are dissolved long before the precipitation of jarosite becomes rapid. It is also possible to complete the decomposition step, separate the gold bearing solid residues, precipitate any dissolved silver, and then reheat the liquid fraction (without necessarily additional neutralization) to precipitate jarosite free of precious metals.

Various trace elements such as copper, magnesium, zinc, bismuth or tellurium may be present in the concentrate being treated. While some of these trace elements will report to the solid residue or waste precipitation residues, some may build up in the liquid phase or the liquid fraction and have to be bled-off. When trace elements are present in sufficient concentration, their recovery may be economically justified.

The applicants have discovered that the process is effective in treating arsenopyritic and pyritic ores which contain carbonaceous material. Some of this carbonaceous material may be active and thus interfere with precious metal recovery. It has been found that the process as demonstrated in Table 1 below renders such carbonaceous material inactive so that the material does not interfere with subsequent gold recovery.

TABLE 1

Deactivation of Carbonaceous Material

| | | % Extraction | |
|---|---|---|---|
| | % C | Au | Ag |
| Untreated concentrate | 2.5 | 86.6 | 89.4 |
| Solid residue | 2.5 | 99.3 | 95.6 |

Table 1 shows that with untreated concentrate (untreated according to the applicants' oxidation-reduction process), only 86.6% extraction of gold and 89.4% silver were achieved. When the same concentrate was treated according to the applicant's process, and even though a relatively high level of carbon was present, 99.3% gold and 95.6% silver recovery levels were obtained.

The operations described can be combined to create processes which will effectively decompose arsenopyrite or pyrite concentrates or ores to produce a residue which can be treated for gold recovery, a liquid fraction from which the silver can be recovered and soluble arsenic, iron and sulphur species can be removed. The liquid fraction can then be reused in the decomposition step.

The gold in the decomposition residue may be readily extracted by conventional techniques such as thiourea-tion, cyanidation, thiosulphate extraction, or treatment with oxidizing chloride leaching agents, such as aqua regia. Any silver in the residue may also be extracted by such techniques.

It is important that the liquid phase of the decomposition step does not contain significant quantities of species which complex gold, for example, chloride ions. These put the gold into solution during the decomposition step and thus require a separate additional process step to extract the gold from the liquid fraction.

Figure 3:
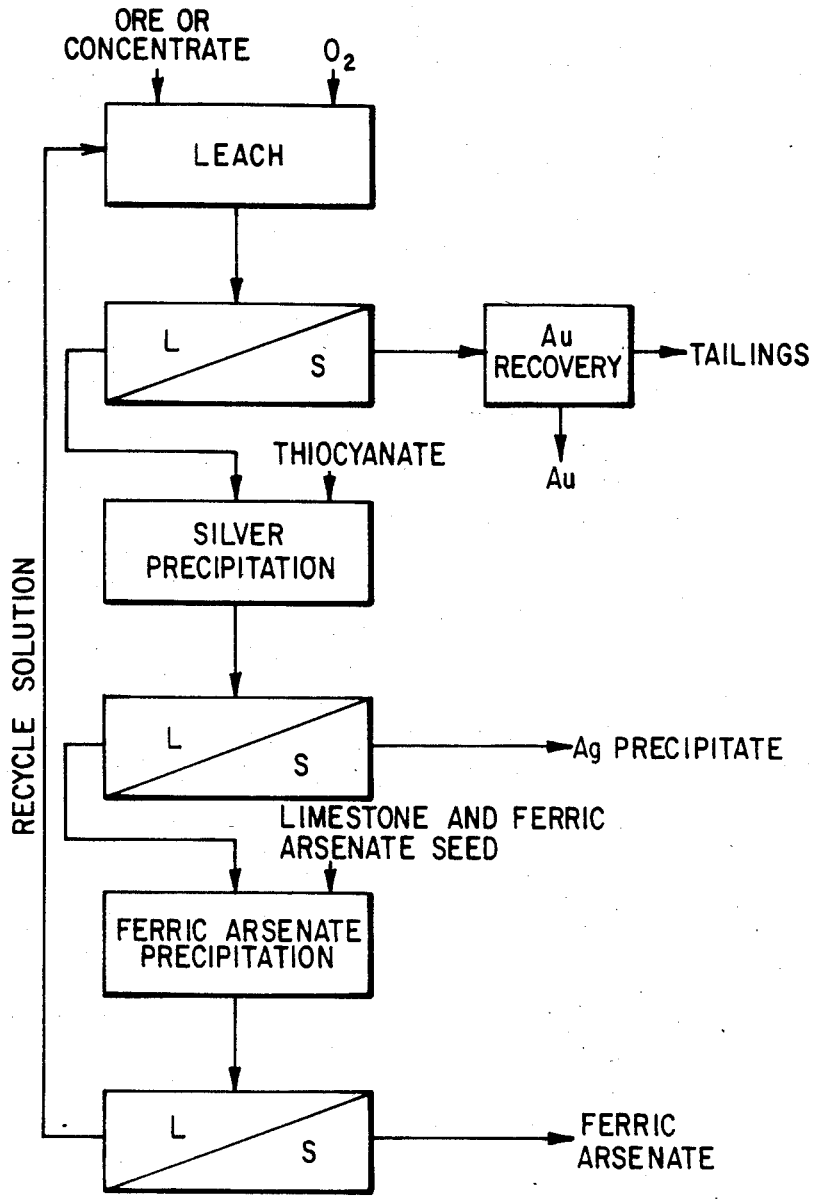
FIG. 3 illustrates a flow sheet of the process of the invention which treats arsenopyrite concentrate or ore.

FIG. 3 illustrates a flow sheet of a typical process according to this invention that can be used to treat an arsenopyrite concentrate or ore. The concentrate or ore is continuously introduced into a reaction vessel (common volume space) along with oxygen and a liquid fraction which is recycled from a subsequent step of the process, to be discussed below, to form a liquid slurry. A continuous concentrate or ore decomposition according to the applicant's process utilizing sub-stoichiometric quantities of oxidized nitrogen species takes place in the reaction vessel. Aqueous liquid slurry is continuously drawn from the reaction vessel and is subjected to a solids-liquid separation. The solid residue is continuously removed and subjected to a gold recovery step. The liquid fraction from the solids-liquid separation is continuously drawn away and subjected to a silver recovery step by thiocyanate precipitation according to the invention. The resulting silver thiocyanate precipitate is continuously separated by filtration. The filtrate remaining is subjected to ferric arsenate precipitation. The precipitated $FeAsO_4.2H_2O$ is removed by settling and filtration. The resultant filtrate is continuously recycled to the decomposition process taking place in the reaction vessel.

Other processes within the overall scheme of the invention can be proposed from the steps described. Some processes are illustrated in the following examples.

EXAMPLE 1

A test was conducted to demonstrate the decomposition of an arsenopyrite concentrate using nitric oxide gas to initiate the decomposition process. Oxygen was added as required to oxidize the nitric oxide to active oxidized nitrogen oxide species for the oxidation-reduction reaction.

An aqueous, acidic slurry was formed by mixing a gold-bearing arsenopyrite concentrate (As 45.5% by weight, Fe 34.2% by weight, S 21.4% by weight, Au 7 oz. per ton) with water and 1.0N sulphuric acid. Specifically, 80 gms of the concentrate was added to 500 ml of water and sulphuric acid comprising 48 gms of sulphuric acid so as to provide a slurry having a pulp density of 160g/l.

The slurry was put into a PARR autoclave of 2 litres volume, after which the autoclave was sealed. This provided an enclosed common volume space in which about 515 ml was occupied by the slurry leaving a gas phase volume of about 1485 ml. One and one half moles of nitric oxide gas were injected into the gas phase. Concurrently, oxygen (99.5 percent purity) was introduced into the gas phase at a pressure of about 100 p.s.i.g.

Almost immediately after introduction of the nitric oxide and oxygen into the autoclave, the temperature of the slurry in the autoclave increased from about 20° C. to 80° C. An agitator was used to keep the concentrate in suspension. The temperature of the slurry inside the autoclave was maintained at 80° C. by cooling coils. The reaction was permitted to continue until it was observed that oxygen consumption had stopped i.e. after about 30 minutes.

After cessation of the reaction, the slurry was removed from the autoclave and subjected to a solid-liquid separation by means of filtration on a BUCHNER filter. The separated solids were then subjected to treatment for the recovery of gold.

Analysis of the reaction products showed the initial conditions, reaction time and the following:

| | |
|---|---|
| FeAsS concentration | 1.0 M |
| Temperature | 80° C. |
| Time | 30 min. |
| Solids density | 160 g/l |
| As solubilization | 100% |
| Fe solubilization | 100% |
| S solubilization | 60% |

EXAMPLE 2

A series of tests were run to demonstrate the decomposition of an arsenopyrite concentrate (as in Example 1) using a sub-stoichiometric quantity of nitric acid solution as a convenient source of oxidized nitrogen species. Oxygen was added as required for oxidation of the arsenopyrite concentrate.

The initial conditions, reaction time and results from a typical test in this series are shown below.

| | |
|---|---|
| $HNO_3$ concentration | 3 M |
| FeAsS concentration | 1 M |
| Temperature | 80° C. |
| Oxygen Pressure | 200 psig |
| Time | 30 min. |
| Solids density | 160 g/l |
| Arsenic solubilization | 100% |
| Iron solubilization | 96% |
| Sulphur solubilization | 84% |
| Au solubilization | 0% |

EXAMPLE 3

A test was conducted on the equipment described in Example 1 to demonstrate the decomposition of a concentrate containing a large fraction of pyrite (4.9% As, 36,9% Fe, 36.2% S) and a small fraction of arsenopyrite. A nitric acid solution was used as the source of a sub-stoichiometric quantity of oxidized nitrogen species. Oxygen was added as required for oxidation of the pyrite concentrate.

| | |
|---|---|
| $HNO_3$ concentration | 3 M |
| $FeS_2$ | 1 M |
| Temperature | 80° C. |
| Oxygen pressure | 200 psig |
| Time | 30 min. |
| Solids density | 160 g/l |
| Iron solubilization | 98% |
| Sulphur solubilization | 95% |
| Au solubilization | 0% |

EXAMPLE 4

A test was performed on the equipment of Example 1 to demonstrate the decomposition of a pyrite-rich concentrate using a ferric nitrate and sulphuric acid solution. The amount of nitrate present was sub-stoichiometric for decomposition of the pyrite. Oxygen was added as required for oxidation of the pyrite concentrate.

| | |
|---|---|
| Initial $Fe(NO_3)_3$ | 0.5 M |
| Initial $H_2SO_4$ | 0.5 M |
| Pyrite concentration | 1 M |
| Temperature | 100° C. |
| Time | 15 min. |

-continued

| | |
|---|---|
| Solids density | 200 g/l |
| Oxygen pressure | 100 psig |

Solubilization of the Fe and S was observed to be complete.

EXAMPLE 5

A test was performed on the equipment of Example 1 to demonstrate the decomposition of a pyrite concentrate using sodium nitrite as the source of sub-stoichiometric quantities of oxidized nitrogen species. Oxygen was added as required for oxidation of the pyrite concentrate.

| | |
|---|---|
| Initial $NaNO_2$ concentration | 1 M |
| Initial $H_2SO_4$ concentration | 0.5 M |
| $FeS_2$ concentration | 1 M |
| Temperature | 100° C. |
| Time | 30 min. |
| Solids density | 200 g/l |

Solubilization of the Fe and S was observed to be complete.

EXAMPLE 6

A test was conducted in a beaker to demonstrate the removal of silver from the liquid fraction obatained in Example 2 (53 g/1 Fe, 72 g/1 As, 2.59 g/1 Ag). Potassium thiocyanate was added as a 10 g/1 solution until the mixture turned a slight purple colour indicating excess thiocyanate.

| | |
|---|---|
| Solution temperature | 70° C. |
| Time | 1 min. |
| Ag | 0.024 M |
| KSCN | 0.026 M |
| Ag removal | 99.8% |

Similar results were obtained with sodium thiocyanate and ammonium thiocyanate.

EXAMPLE 7

Two tests were performed in the autoclave of Example 1 to demosnstrate the precipitation of ferric arsenate from a solution containing 1 mole ferric nitrate and 1 mole arsenic acid. No sulphate was present in the solution.

| | Test 1 | Test 2 |
|---|---|---|
| $Fe(NO_3)_3$ concentration | 1 M | 1 M |
| As concentration | 1 M | 1 M |
| Precipitation temperature | 100° C. | 200° C. |
| Time | 120 min. | 60 min. |
| Fe removal | 94% | 97% |
| As removal | 95% | 98% |

EXAPMLE 8

Two tests were conducted in the autoclave of Example 1 to demonstrate the effect of neutralization and sulphate removal on the precipitation of ferric arsenate from the solution of Example 7 except that the solution also contained 0.5 mole sulphate. To remove sulphate, calcium carbonate was added to the solution at 100° C. and the evolved $CO_2$ was released.

| | Test 1 | Test 2 |
|---|---|---|
| As concentration | 1 M | 1 M |
| Fe concentration | 1 M | 1 M |
| $SO_4^{2-}$ concentration | 0.5 M | 0.5 M |
| $CaCO_3$ added | | 0.5 M |
| Precipitation temperature | 200° C. | 200° C. |
| Time | 60 min. | 60 min. |
| As removal | 66% | 98% |
| Fe removal | 72% | 96% |
| $SO_4^{2-}$ removal | 5% | 59% |

EXAMPLE 9

A series of tests was performed in the autoclave of Example 1 to demonstrate an entire process which would treat an arsenopyrite concentrate containing a large fraction of arsenopyrite (as in Example 1). The decomposition step was the same as for Example 2.

| | |
|---|---|
| $HNO_3$ concentration | 3 M |
| FeAsS concentration | 1 M |
| Temperature | 80° C. |
| Time | 30 min. |
| Oxygen pressure | 200 psi |
| Solids density | 160 g/l |
| As solubilization | 96% |
| Fe solubilization | 99% |
| S solubilization | 82% |

After filtration, calcium carbonate was added to the liquid fraction at 100° C., the $CO_2$ evolved was released and calcium sulphate and ferric arsenate salts were preceipitated as in Example 8. The removal figures shown are relative to the starting solution.

| | |
|---|---|
| As concentration | 0.9 M |
| Fe concentration | 0.9 M |
| $SO_4^{2-}$ concentration | 0.7 M |
| $CaCO_3$ added | 0.7 M |
| Precipitation temperature | 200° C. |
| As removal | 98% |
| Fe removal | 96% |
| S removal | 76% |

The resulting solution from the precipitation was then used for a second decomposition step in the autoclave with arsenopyrite concentrate as indicated in Example 2. The extraction figures are relative to the added concentrate.

| | |
|---|---|
| Temperature | 80° C. |
| Oxygen pressure | 220 psig |
| Pulp density | 160 g/l |
| FeAsS concentration | 1 M |
| As solubilization | 97% |
| Fe solubilization | 97% |
| S solubilization | 60% |

EXAMPLE 10

A test was performed (as in Example 9) to demonstrate the precipitation of ferric arsenate from solution at 100° C. The solution used was produced as in Example 9 and the resultant solution with the arsenic, iron and sulphur precipitated from it was used to decompose concentrate with results similar to those shown in Example 9.

| | |
|---|---|
| As concentration | 1 M |
| Fe concentration | 1 M |
| $SO_4^{2-}$ concentration | 0.6 M |
| $CaCO_3$ added | 0.8 M |
| Precipitation temperature | 100° C. |
| Time | 16 hr. |
| As removal | 97% |
| Fe removal | 99% |
| $SO_4^{2-}$ removal | 69% |

As will be apparent to those skilled in the art in the light of the foregoing disclosure, many alterations and modifications are possible in the practice of this invention without departing from the spirit or scope thereof. According, the scope of the invention is to be construed in accordance with the substance defined by the following claims.

We claim:

1. A hydrometallurgical process for the recovery of precious metal from an ore or concentrate containing arsenopyrited or pyrite wherein precious metal is occluded in arsenopyrite or pyrite, which process comprises:

(a) forming in a common volume space a gas phase comprising air and water vapor and a liquid slurry comprising the ore or concentrate as the solid phase and acid and water as the liquid phase of the slurry;

(b) effecting in the slurry between the arsenopyrite or pyrite and an oxidized nitrogen species in which the nitrogen has a valence of at least plus 3 an oxidation-reduction reaction having a standard potential between about 0.90 and about 1.20 volts on the hydrogen scale, thereby solubilizing in the liquid phase the arsenic, iron and sulfur in the arsenopyrite, or the iron and sulfur in the pyrite, all as the oxidation products, and producing in the liquid phase nitric oxide in which the nitrogen has a valence of plus 2, as the reduction product;

(c) releasing nitric oxide from the liquid phase into the gas phase;

(d) oxidizing the nitric oxide in the gas phase, in which an oxygen partial pressure above the ambient oxygen partial pressure in air is maintained by continuous addition of an oxygen containing gas, to form an oxidized nitrogen species in which the nitrogen has a valence of at least plus 3, the total amount of oxygen added being at least in an amount stoichiometrically required for solubilization in the liquid phase of the arsenic, iron and suphur in the arsenopyrite or the iron and sulfur in the pyrite;

(e) absorbing the oxidized nitrogen species into the slurry wherein the oxidized nitrogen species become available for the oxidation-reduction reaction of step (b) whereby the nitrogen, in its oxide forms, functions as a catalyst for the transport of oxygen from the gas phase to the oxidation-reduction reactions in the slurry, thereby permitting the total of the oxidized nitrogen species and nitric oxide in the system to be less than a stoichiometric balance required for the oxidation of the arsenic, iron and sulphur;

(f) subjecting the slurry to a solid-liquid separation to produce a solid residue and a liquid fraction; and (g) recovering precious metal from the solid residue.

2. A process as defineed in claim 1 wherein the oxidation-reduction reaction has a standard potential of at least 0.94 and less than about 1.0 volts on the hydrogen scale.

3. A process as defined in claim 2 wherein the nitrogen in the oxidized nitrogen species has a valence of +3 or +4.

4. A process as defined in claim 2 wherein at least about 90 percent by weight of the arsenic and iron in arsenopyrite or the iron in the pyrite is solubilized and at least 60 percent by weight of the sulfur in the arsenopyrite or pyrite is solubilized.

5. A process as defined in claim 4 wherein the process is initiated by the addition to the common volume space of an oxidized nitrogen species of a valence of at least +2.

6. A process as defined in claim 5 wherein the oxidized nitrogen species is added to the gas phase as NO, $NO_2$ or $N_2O_4$.

7. A process as defined in claim 5 wherein the oxidized nitrogen species is added to the liquid phase as $HNO_3$, $NaNO_3$, $KNO_3$, $NaNO_2$, $Fe(NO_3)_3$, $NH_4NO_3$, $Ca(NO_3)_2$ or $Mg(NO_3)_2$.

8. A process as defined in claim 4 wherein the liquid fraction is recycled to the liquid phase in the process.

9. A process as defined in claim 4 wherein the solubilized iron, arsenic and sulfur are precipitated from the liquid fraction and the precipitated iron, arsenic and sulfur are removed from the process and the liquid fraction is recycled to the liquid phase in the process.

10. A process as defined in claim 9 wherein the liquid fraction is recycled to the liquid phase and the liquid fraction contains the oxidized nitrogen species required to initiate and maintain the process.

11. A process as defined in claim 4 wherein steps (a) to (e) are conducted within a residence time of about 2 minutes to about 60 minutes.

12. A process as defined in claim 4 wherein the oxidation-reduction reaction is conducted at a temperature of about 60° C. to about 180° C.

13. A process as defined in claim 4 wherein the oxidation-reduction reaction is conducted at a pH of less than about 3.

14. A process as defined in claim 4 wherein the oxidation-reduction reaction is conducted at a pH of less than about 1.

15. A process as defined in claim 4 wherein the oxidized nitrogen species concentration is between about 0.25M and about 4.0M.

16. A process as defined in claim 4 wherein the oxidized nitrogen species concentration is between about 0.5M and about 3.0M.

17. A process as defined in claim 9 wherein solubilized iron, arsenic or sulfur is precipitated as jarosite and ferric arsenate from the liquid fraction by raising the temperature of the liquid fraction to a temperature of about 100° C. and removing precipitated solids from the liquid fraction before recycling the liquid fraction to the liquid phase.

18. A process as defined in claim 9 wherein solubilized iron, arsenic or sulfur is precipitated as jarosite, ferric arsenate and calcium sulfate from the liquid fraction by neutralizing acid generated by pyrite oxidation, and removing precipitated solids from the liquid fraction before recycling the liquid fraction to the liquid phase.

19. A process as defined in claim 9 wherein a calcium bearing substance or a barium bearing substance is used to remove solubilized sulphur from the liquid fraction, ferric arsenate is added as a nucleating agent, and the liquid fraction is heated to precipitate ferric arsenate.

20. A process as defined in claim 19 wherein the liquid fraction is heated to about 100° C.

21. A process as defined in claim 4 wherein the preceious metal is gold or silver.

22. A process as defined in claim 4 wherein the ore or concentrate contains silver and the silver is recovered fromthe liquid fraction by using at least a stoichiometric quantity of a thiocyanate substance selected from the group consisting of sodium thiocyanate, potassium thiocyanate and ammonium thiocyanate, to precipitate the silver.

23. A process as defined in claim 22 wherein the thiocyanate substance is potassium thiocyanate.

24. A process as defined in claim 4 wherein the process renders carbonaceous material present in the ore or concentrate inactive.

25. A process as defined in claim 4 wherein arsenic trioxide is recovered from the liquid fraction by cooling the liquid fraction.

26. A process as defined in claim 1 wherein the oxygen partial pressure is between about 50 psig and about 100 psig.

27. A process for removing arsenic and irom from an acidic aqueous solution of a pH of less than about 1, the solution containing nitric acid, solubilized arsenic, iron and sulfur which comprises adding a calcium or barium bearing substance selected from the group consisting of calcium oxide, calcium hydroxide, calcium cabonate and barium carbonate to remove solubilized sulfur from: the solution, while maintaining the solution at a pH of less than about 1, adding a nucleating agent to the solution, and heating the solution to precipitate crystalline ferric arsenate.

28. A process as defined in claim 27 wherein ferric arsenate is added to the solution as the nucleating agent.

29. A process as defined in claim 28, wherein the solution is heated to at least about 100° C.

* * * * *